US005598728A

United States Patent [19]

Lax

[11] Patent Number: 5,598,728

[45] Date of Patent: Feb. 4, 1997

[54] SECURITY CASE

[75] Inventor: Michael Lax, Westbury, N.Y.

[73] Assignee: Autronic Plastics, Inc., Westbury, N.Y.

[21] Appl. No.: 398,280

[22] Filed: Mar. 3, 1995

[51] Int. Cl.[6] ..... E05B 47/00

[52] U.S. Cl. ..... 70/276; 70/58; 70/63; 70/57.1

[58] Field of Search ..... 70/58, 57.1, 57, 70/63, 276, 163, 164, 166–169, 159–162; 292/251.5, 150; 40/312, 630, 638

[56] References Cited

U.S. PATENT DOCUMENTS

| | | | |
|---|---|---|---|
| 517,729 | 4/1894 | Cable . | |
| 1,707,225 | 4/1929 | Jackson . | |
| 2,730,392 | 1/1956 | Thiebaud | 292/201 |
| 3,495,716 | 2/1970 | Gregory | 206/387.11 |
| 3,837,525 | 9/1974 | Kobayashi | 220/55 K |
| 3,855,827 | 12/1974 | Hallman et al. | 70/134 |
| 3,933,240 | 1/1976 | Humble | 206/387.11 |
| 4,453,743 | 6/1984 | Sanders et al. | 281/18 |
| 4,469,225 | 9/1984 | Takahashi | 206/387 |
| 4,819,797 | 4/1989 | Holmgren | 206/309 |
| 4,966,020 | 10/1990 | Fotheringham et al. | 70/276 |
| 4,972,690 | 11/1990 | O'Sullivan | 70/63 |
| 5,007,256 | 4/1991 | Lowe | 70/14 |
| 5,103,978 | 4/1992 | Secor | 40/312 |
| 5,193,371 | 3/1993 | Yamane | 70/276 |
| 5,209,086 | 5/1993 | Brühwiler | 70/57.1 |
| 5,368,162 | 11/1994 | Holmgren | 206/387 |
| 5,375,712 | 12/1994 | Weisburn | 206/387.11 |

*Primary Examiner*—Steven N. Meyers
*Assistant Examiner*—Tuyet-Phuong Pham
*Attorney, Agent, or Firm*—Lowe, Price, LeBlanc & Becker

[57] ABSTRACT

A security device includes a case with a lid to receive merchandise and a locking mechanism for latching the case closed. The locking mechanism has a housing with parallel flanges to overlie a portion of the lid and another surface of the case, preventing the lid from being opened. One end of the locking mechanism is fixed and the other is movable between open and closed positions, and a mechanism in the housing retains the movable end closed. A decoupler is provided for opening the locking mechanism.

17 Claims, 6 Drawing Sheets

SECURITY CASE

FIELD OF THE INVENTION

The invention relates generally to protecting merchandise in a retail setting. More particularly, the invention relates to a security case for video game cartridges and CDs which are marketed on live display.

BACKGROUND OF THE INVENTION

When video rental stores first began operating, the merchandising format used was a "fetch system". In a fetch system, empty display boxes are exhibited on shelves and a customer selects a title by physically bringing the empty display box to a clerk at the check out counter. The clerk then "fetches" the cassette of the selected title from a secure location where the actual cassettes are kept and delivers it to the customer. While this format has high security, it is not appealing as it increases labor and time to provide a customer with the cassette of the selected title and requires expanded inventory space to store separately the cassettes and empty display boxes.

To solve these problems, the merchandising format for video rental stores has changed to leave all the cassettes out in the store "live"; i.e. the cassettes are left in the displayed boxes. In such a "live" video rental store, a customer selects a title and brings the display box, with the cassette inside, to the check out counter. Thus, the live merchandising format decreases cost by saving on labor and time, and reducing the amount of inventory space. To provide security against pilferage in a live merchandising format, video rental stores usually place a security strip on the cassette, or on or in the display box. However, if the security strip is placed on the cassette, it must be positioned so as not to interfere with the operation of a video cassette recorder. When the security strip is in place, an alarm will sound if there is an attempt to conceal the item when leaving the store with a customer. This has been found to be quite successful in preventing pilferage so long as the security strip is in place. However, the security can be bypassed by removing the cassette from the display box when the security strip is in or on the box, or "peeling" the security strip from the cassette. While theft of cassettes does occur in this manner, the problem has not been serious since it is believed that most customers consider the size of the cassettes to be too large to be easily concealed.

Recently, rental of video games has become a substantial part of the business of video rental stores. These video games are packaged as a cartridge having a particular shape depending upon the brand of video game machine for which it is designed. It has been found that when a live merchandising format and security strip are used for video game cartridges, substantial pilferage occurs. This is believed to result from the fact that a video game cartridge is substantially smaller than a video cassette and therefore, more easily concealed. When the security strip is placed somewhere on or in the display box, it is quite easy to steal the video game by removing the cartridge from the display box and then concealing it while leaving the store. The same is true when the security strip is placed on the video game cartridge since the security strip can be "peeled" away. As a result, most video rental stores keep video game cartridges in a secure place, separate from the display boxes. This means that the stores have returned to the old "fetch system" which requires increased inventory space, labor and time. In addition, the "fetch system" is contradictory to the live merchandising format for which the video rental store is usually set up.

Even more recently, video games have been marketed on compact disks (CDs). If a live merchandising format is used for the CDs, then the security strip must be placed on or in the display box since a security strip cannot be placed on the CD itself. As a CD is even more easily concealed than a video game cartridge, video rental stores have been forced to use a "fetch system" for video games on CDs to reduce pilferage.

Since the quality of playback for video on a CD is superior to that on a tape cassette, it is anticipated that most movies will eventually be marketed on CDs. Thus, video rental stores expect that a large portion of their inventory will be made up of CDs. Accordingly, there is a need to provide protection for video game cartridges and CDs without increasing inventory space, labor and time.

SUMMARY OF THE INVENTION

It is a feature and advantage of the invention to provide a novel mechanism for protecting displayed merchandise from theft.

It is another feature and advantage of the invention to provide a novel mechanism for protecting video game cartridges and CDs consistent with a live merchandising format, requiring no increase inventory space, and being simple and convenient to use.

It is another feature and advantage of the invention to provide a novel mechanism for protecting video game cartridges and CDs compatible with the use of a security strip.

It is another feature and advantage of the invention to make a security strip inaccessible to customers when it is used to protect video game cartridges and CDs.

According to the present invention, the foregoing features and advantages are attained by a security device comprising a case and locking mechanism for latching the case. The case has a lid opening to receive merchandise, a bottom surface and two opposing sidewall surfaces each having a recess or notch near the lid opening. The locking mechanism includes a housing with a fixed member for engaging one of the recesses or notches of the case, two parallel flanges extending from the housing to overlie a portion of the lid and another surface of the case, preventing the lid from being opened, and a movable member for engaging the other recess or notch of the case. The movable member extends beyond an end of the housing and flanges when the locking mechanism is open and aligns with the end of the housing and flanges when the locking mechanism is closed, and means in the housing retains the movable member when the locking mechanism is closed.

In accordance with one aspect of the invention, two steel pins, each retained in a sleeve attached to an inner surface of the base housing, and means for biasing each steel pin against a surface of the movable member.

In accordance with another aspect of the invention a decoupler is provided for opening the locking mechanism. The decoupler is a U-shaped housing having a flat upper surface, two inner surfaces extending from the flat upper surface, an outer surface corresponding to each inner surface, a vertical cross rib attached to the flat upper surface, and a magnet positioned in the housing between each inner surface and the corresponding outer surface. The magnets attract the steel pins when the closed locking mechanism is positioned in the decoupler with the movable member engaging the vertical cross rib.

In accordance with still another aspect of the invention an upper surface of the base housing has a recess for receiving a security strip.

Still other features and advantages of the present invention will become readily apparent to those skilled in this art from the following detailed description, where only the preferred embodiment of the invention is shown and described, simply by way of illustration of the best mode contemplated of carrying out the invention. As will be realized, the invention is capable of other and different embodiments in various obvious respects, all without departing from the invention. Accordingly, the drawings and description are to be regarded as illustrative in nature, and not as restrictive.

DETAILED DESCRIPTION OF THE DRAWINGS

Figure 1:
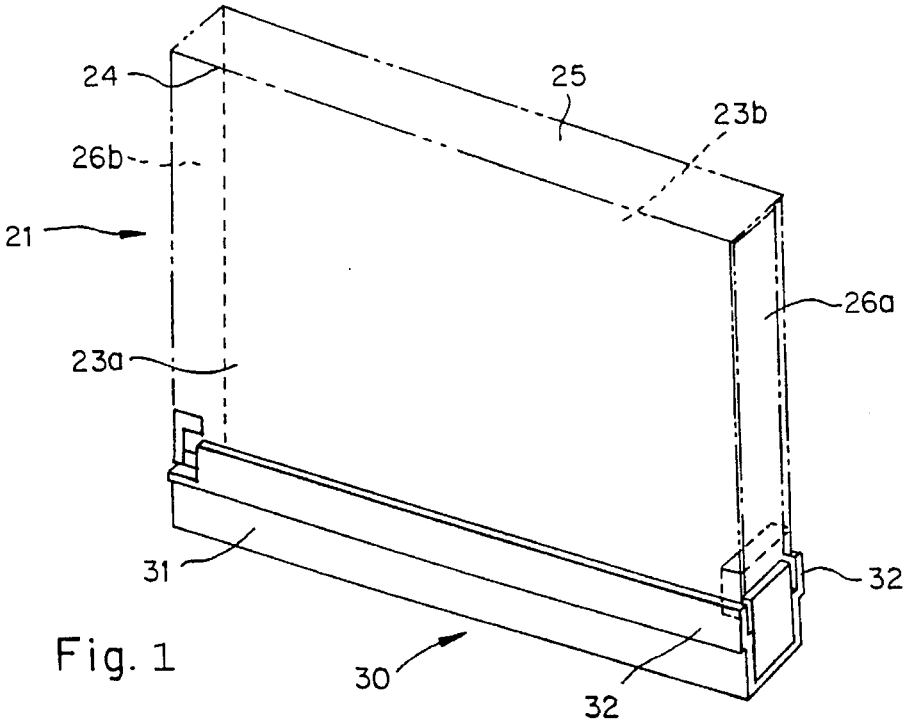
FIG. 1 is a perspective view of a security case of the present invention with the case latched.

Referring to FIGS. 1–4, a security case of the present invention includes a case 21 for holding merchandise and a lock 30 for latching the case closed. While the preferred embodiment assumes that video game cartridges or CDs will be retained in the case 21, it should be readily apparent to those skilled in the art that other types of merchandise can be retained, and the present invention is not limited by the particular type of merchandise which is held in the case.

The case 21 is generally in the shape of a rectangular box, with a lid 23*a*, bottom 23*b*, spine 25 and sidewalls 26*a*, 26*b*, 26*c*. In the preferred embodiment, the lid 23*a* is attached to the spine 25 at an edge 24 using a "living" hinge. However, other means of hinging the lid can be used. The case can be of any size depending on the size of the merchandise which is to be placed inside. The lid 23*a*, bottom 23*b* and spine 25 project slightly beyond the sidewalls 26*a*, 26*b* and 26*c*, as shown in FIGS. 1–4 along sidewall 26*a*. Ends of the sidewalls 26*a* and 26*b* opposing the spine 25 (FIG. 4) have recesses or notches 27.

Figure 10:
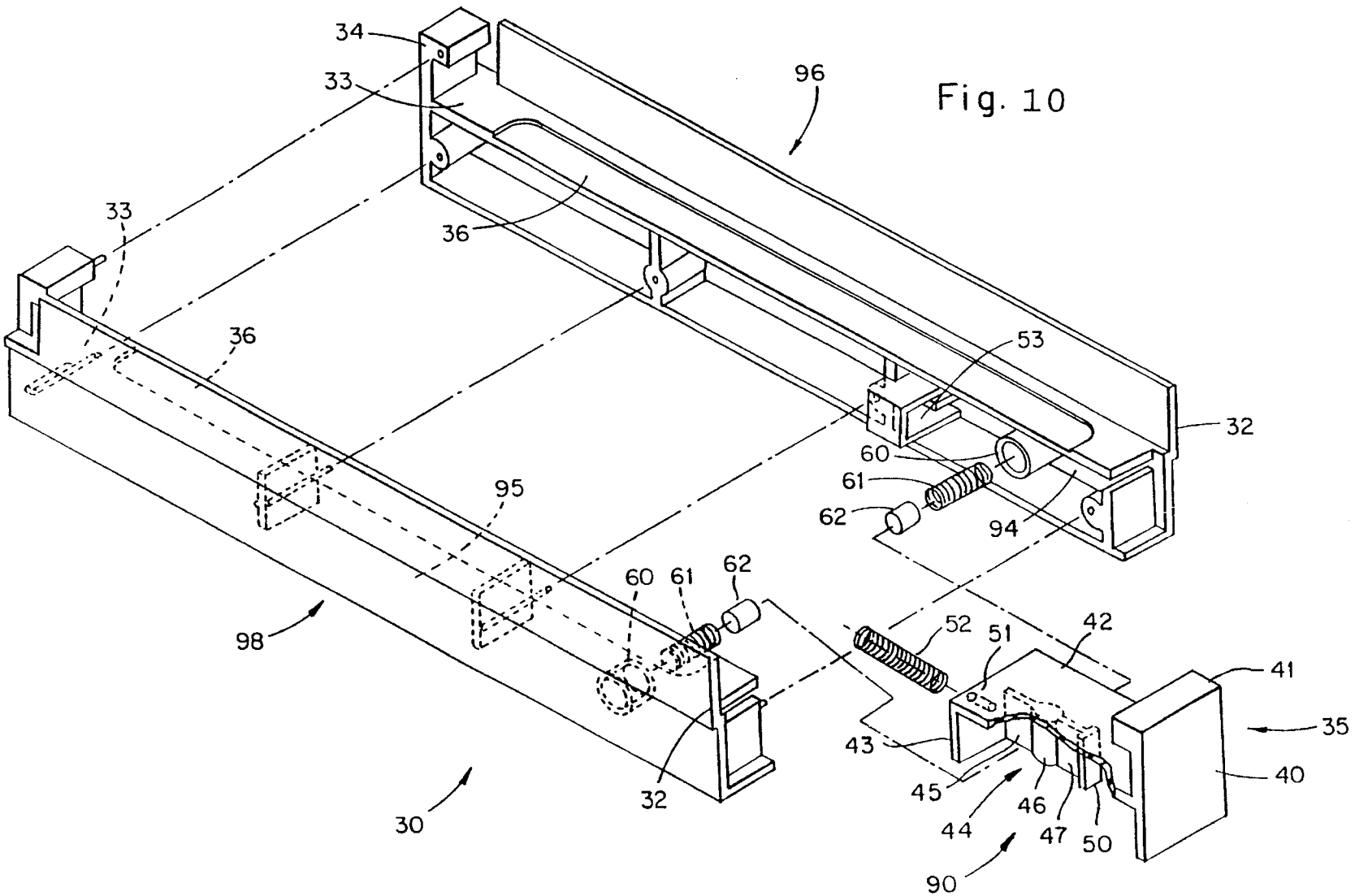
FIG. 10 is an exploded general perspective of the locking mechanism and actuator.

The lock 30 is constructed as shown in FIG. 10 with a housing 31, an actuator 90 at one end of the housing, and parallel flanges 32 extending from a cross-piece 33 of the housing 31. The housing is comprise of two portions 96 and 98 permanently connected to each other, for example by sonic welding. The portions 96 and 98 are substantially mirror images of each other, but portion 96 has a slot 53, to be described later, formed on an inner wall 94. The flanges 32 are spaced apart from each other by a distance slightly greater than the maximum width of the case 21. These flanges overlie a portion of the lid 23*a* and the bottom 23*b* of the case when the case is positioned on the cross-piece 33 of the housing 31. One end of the lock 30 has a fixed L-shaped hook 34 and the other end has a movable L-shaped hook 35. The movable L-shaped hook 35 is part of an actuator 90 for latching the lock to a case, to be described later.

Figure 5:
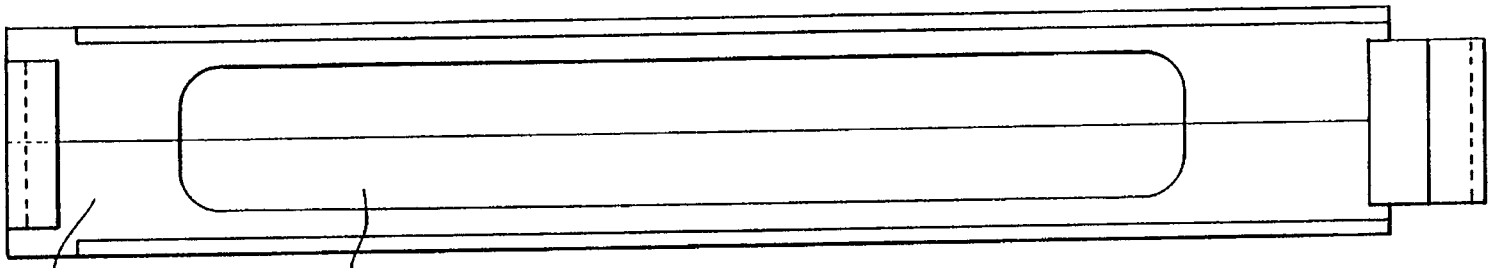
FIG. 5 is a top view of the locking mechanism.

Referring to FIG. 5, cross-piece 33 of the housing 31 has a recess 36 designed to provide a location for a security strip to be used with the lock. When a security strip is placed in the recess 36 and the lock 30 is fastened to the case 21, the security strip is inaccessible to the customer and remains with the merchandise until the lock is removed. Thus, if a customer attempts to exit the store concealing case 21 with lock 30 fastened, an external alarm (not shown) will sound.

Figure 4:
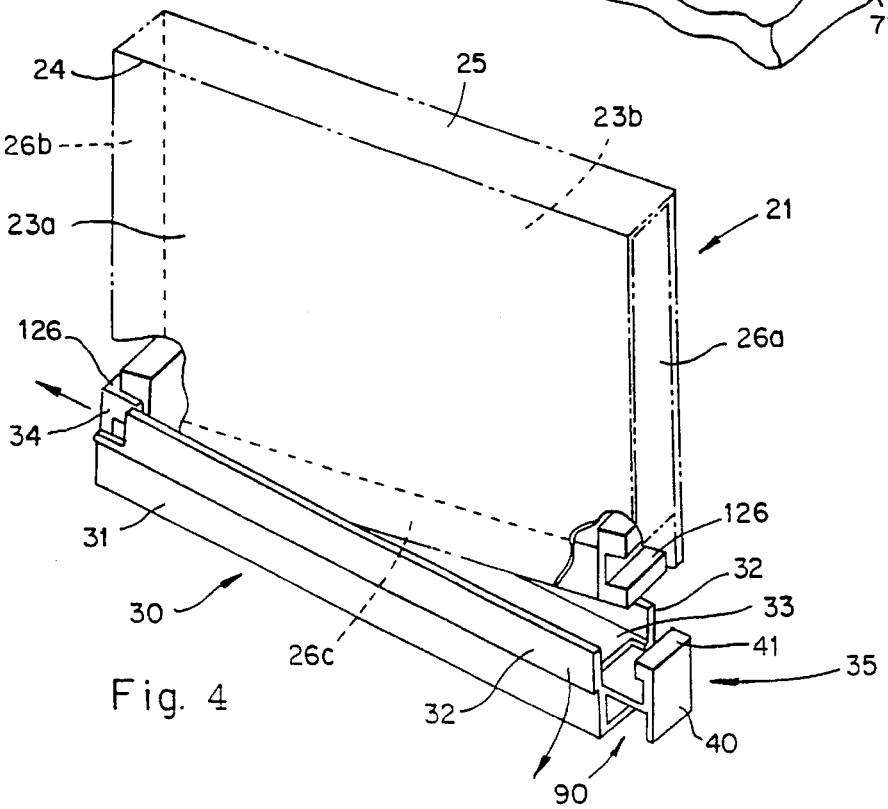
FIG. 4 is a view of the locking mechanism being removed from the case.
Figure 6:
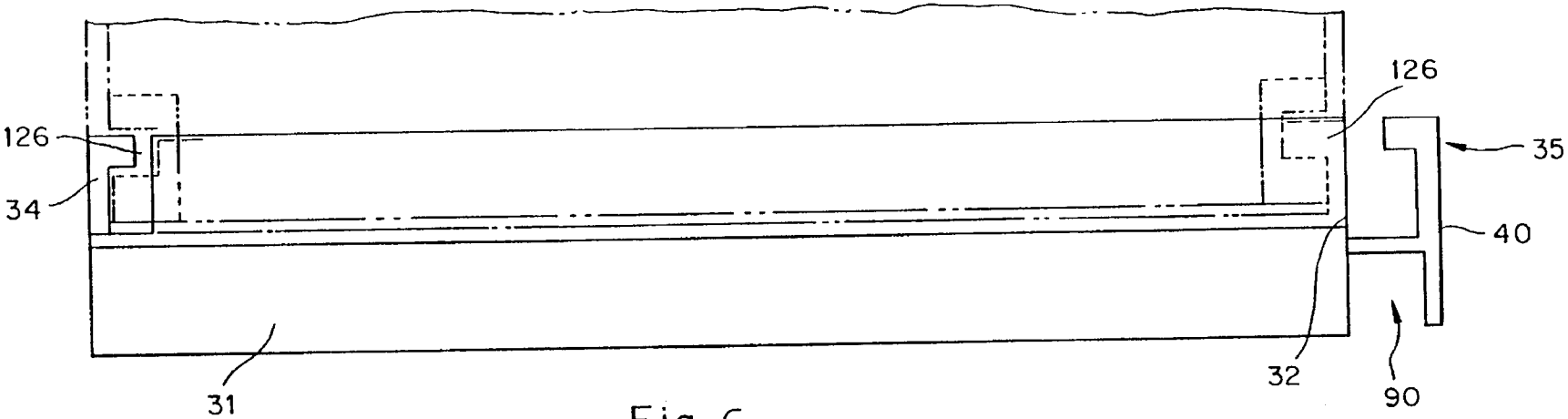
FIG. 6 is a side view of the locking mechanism unlocked from the case.

Both the fixed L-shaped hook 34 and movable L-shaped hook 35 engage the recesses or notches 27 when the lock is latched to the case as shown in FIG. 1. To fasten the lock 30 to the case 21, the case is first placed on the cross-piece 33 of the lock housing 31 and positioned so that the fixed L-shape hook 34 engages one of the recesses or notches 27 (FIG. 4). The actuator 90 is in the open position with the movable L-shaped hook 35 located as shown in FIG. 6, i.e., aligned to engage the other recess or notch 27. The actuator is then pressed to engage the movable L-shaped hook 35 in the other recess or notch 27. When the actuator reaches the closed position with the hook 35 now seated in the recess or notch 27, a mechanism (to be described hereinafter) locks the actuator in position, securing the lock 30 to the case 21.

Referring to FIG. 10, the actuator 90 and mechanism for locking the actuator in position is described. The actuator comprises the L-shaped hook 35, a portion 42 extending inward from the L-shaped hook and another portion 43 extending downward. External portions 40 and 41 form the L-shaped hook with portion 41 extending parallel to the cross-piece 33. The portions 42 and 43 of the actuator 90 move longitudinally between the ends of the lock 30 beneath the cross-piece 33 when the actuator is opened or closed. Another cross-piece 44 formed beneath the actuator portion 42 has one end attached to actuator portion 43 with the other end extending a prescribed distance towards the hook portion 40. A wall 50, parallel to the portions 40 and 43, is formed at the other end of the cross-piece 44.

A protrusion 51 extending from the actuator portion 43 towards the fixed L-shaped hook 34 is adapted to receive a spring 52. The spring 52 fits over the protrusion 51 and has one end resting against the portion 43. The other end of the spring rests against a back surface of the slot 53 formed between the inner walls of the housing 31. The length of the portion 51 is designed so that the free end of the protrusion does not strike the back surface of the slot 53 when the actuator is in the closed position.

Sleeves 60 are formed on opposing sides of the inner walls 94 and 95 of the housing 31. Each sleeve, adapted to receive a spring 61 and steel pin 62, allows the steel pin under load from the spring to freely engage the cross-piece 44. The length of each steel pin is such that the pin does not extend beyond the outer edge of the sleeve when the spring 61 is fully compressed.

The shape of the cross-piece 44 between the wall 50 and the portion 43 is designed to facilitate latching of the actuator using the spring loaded steel pins 62. In particular, each side of the cross-piece 44 has, in succession, a flat segment 45, a curved segment 46, and another flat segment 47. The curvature of the segment 46 is greater at the junction to the flat segment 47 than at the junction to the flat segment 45. The wall 50, the flat segment 47, and the junction between the flat segment 47 and the curved segment 46 form a seat on each side of the cross portion 44 for the steel pins 62. When the actuator is in the closed position, the steel pins are retained in the seats by the force exerted by the springs 61.

Figure 7A:
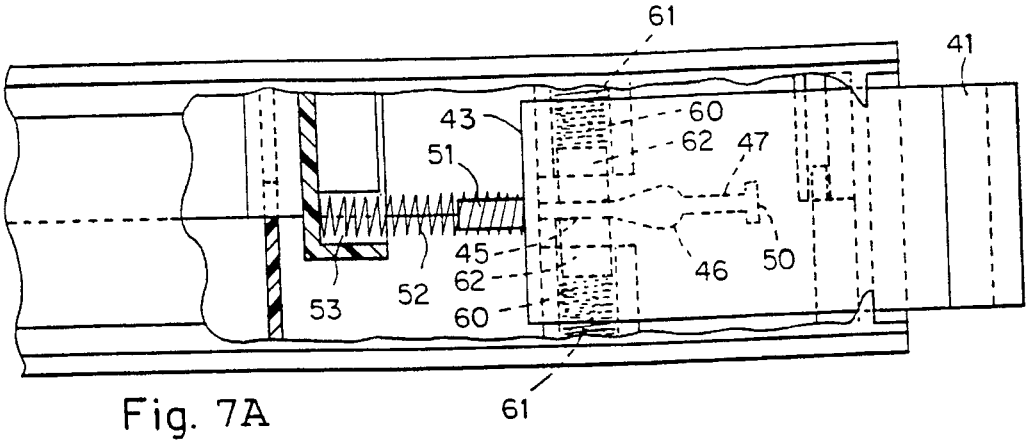
FIGS. 7A to 7C are sectional views of the bottom of the locking mechanism showing the actuator progressing from an open to a closed position.
Figure 7B:
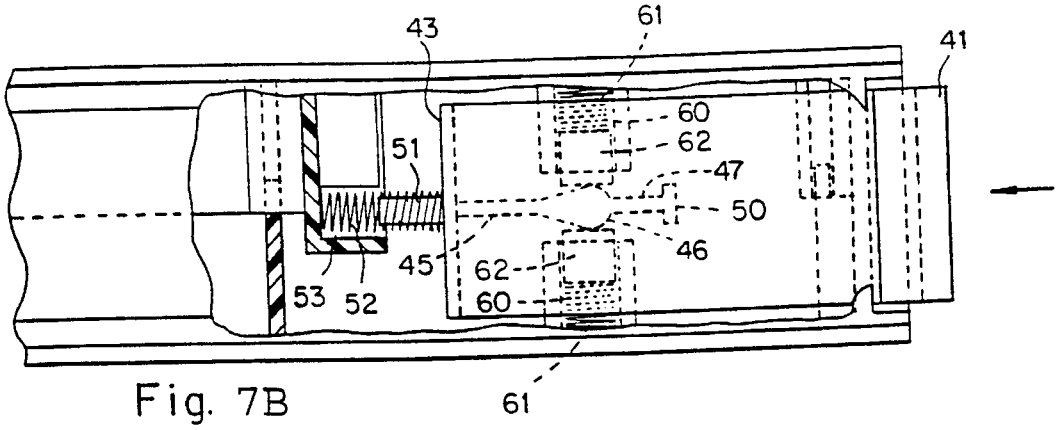
Figure 7C:
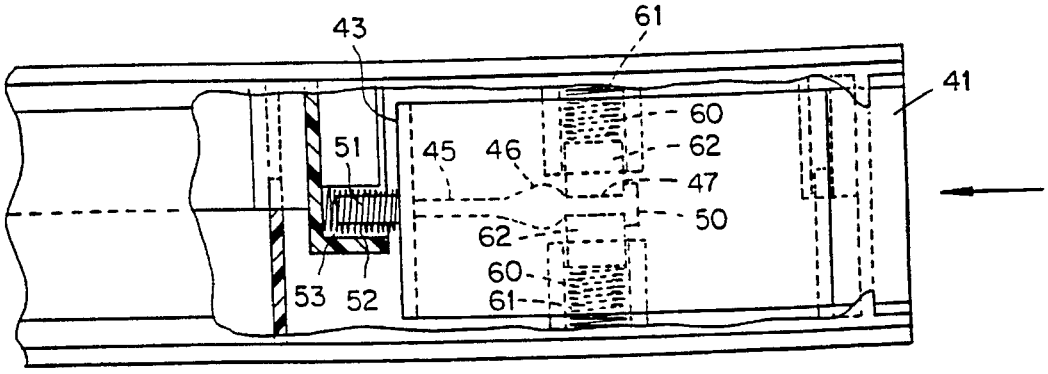

Description will now be made of the operation of the mechanism for latching the actuator closed with reference to FIGS. 7A–7C. As shown in FIG. 7A, when the actuator is open, the movable L-shaped hook 35 extends beyond the ends of the flanges 32, the spring 52 is almost fully decompressed and the springs 61 are less than fully compressed. The load of the springs 61 forces the steel pins 62 to rest against the flat segments 45. When a lateral force is applied to the portion 40 manually, the movable L-shaped hook 35 is forced towards the fixed L-shaped hook 34, further compressing the spring 52. At the same time, the steel pins 62 move along the curved segments 46, further compressing the springs 41 as shown in FIG. 7B. As the actuator moves to the closed position, the spring 52 continues to compress, and at the same time, the springs 61 decompress slightly, rapidly forcing the steel pins 62 into the seats formed by the wall 50, the flat segment 47, and the junction between the flat segment 47 and the curved segment 46. The load exerted on the portion 43 by the compressed spring 52 causes an outer edge of each of the steel pins 62 to rest against the junction between the curved segment 46 and the flat segment 47. When the actuator is closed, with the L-shaped hooks 34 and 35 engaging the recesses or notches 27 of the case 21, the lock 30 cannot be removed from the case as the force exerted on the steel pins 62 by the springs 61 lock the steel pins in their seats.

Referring now to FIGS. 2, 3, 8 and 9, a decoupler 70 for releasing the actuator has a U-shaped housing which is positioned near a counter. Screws 81 (only one is shown) are used to fasten the decoupler to the counter, although other suitable means for fastening may be employed. The decoupler 70 has a base 71, outer surfaces 72, a flat surface 73, and inner surfaces 74 extending from the flat surface 73. The inner surfaces 74 each have a first portion 75 and a second portion 76 perpendicular to the surface 73. The distance between the first portions 75 is slightly greater than the width of the housing 31 of the lock 30, and the distance between the second portions 76 is slightly greater than the width of the flanges 32. This arrangement results in the formation of ledges 77. Because the flanges 32 of the lock 30 are wider than the base 31, the lower surfaces of the flanges 32 ride on the ledges 77 during a release operation. A magnet 78 is positioned in the decoupler between each outer surface 72 and the first portion 75 of each inner surface 74. A vertical cross rib structure 80 is attached to the flat surface 73. Both the position of the magnets in the decoupler and the position of the vertical cross rib structure 80 on the flat surface 73 are arranged so that, during the release operation, the outer surface of the portion 40 of the actuator engages the vertical cross rib structure as the steel pins 62 align approximately with the center of the magnets 78.

Figure 2:
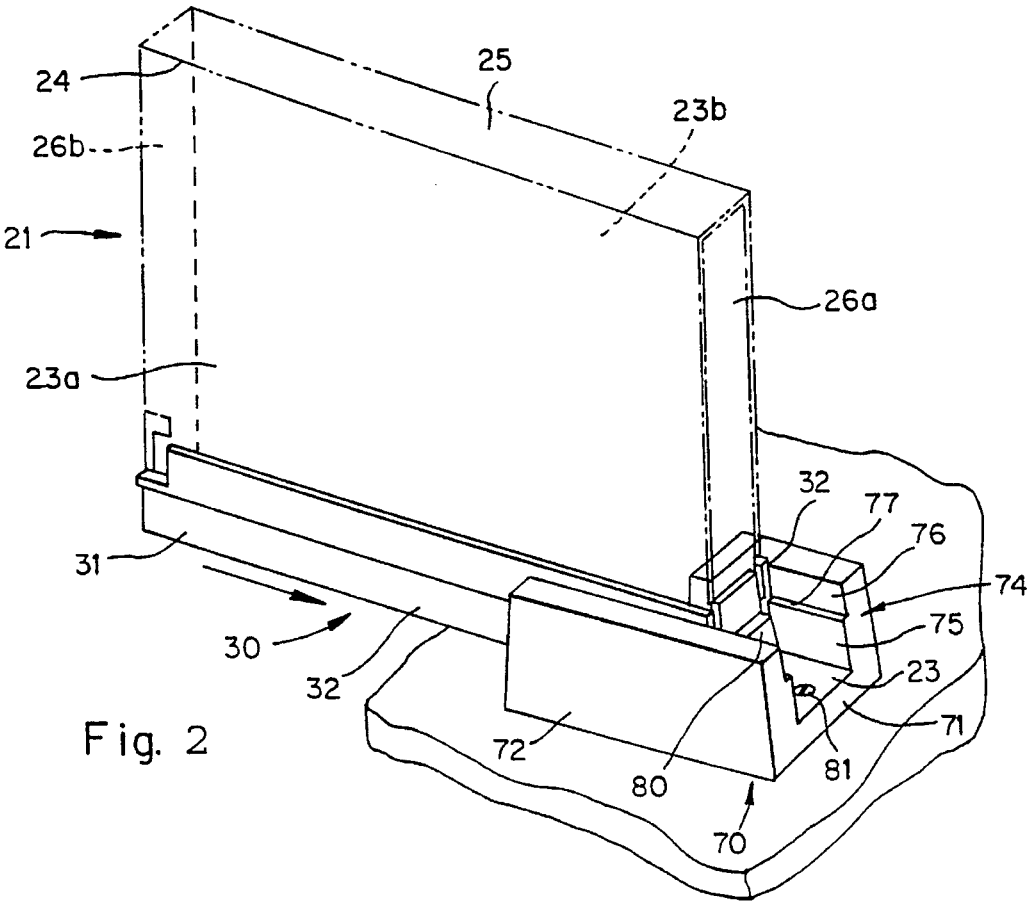
FIG. 2 is a perspective view of the security case with a locking mechanism engaging the locking mechanism decoupler.
Figure 3:
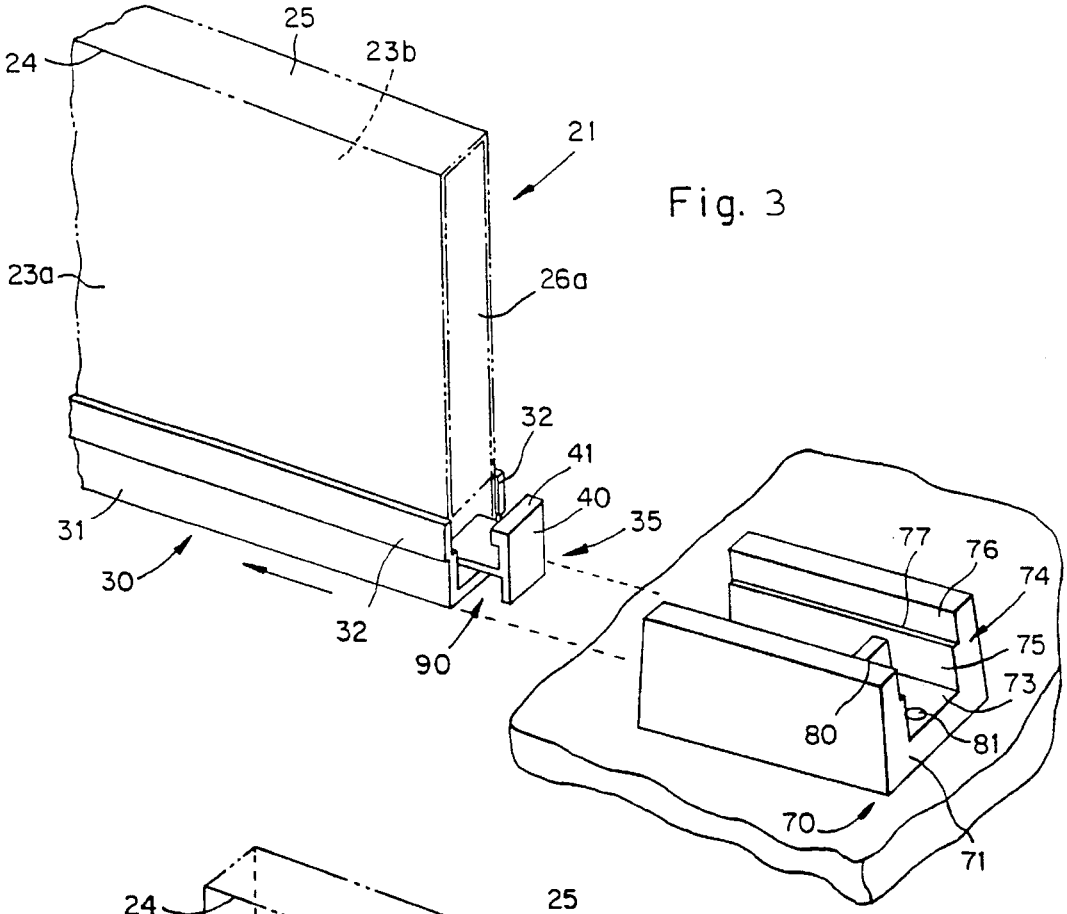
FIG. 3 is a perspective view of the security case after the locking mechanism has been unlocked by the decoupler.
Figure 8:
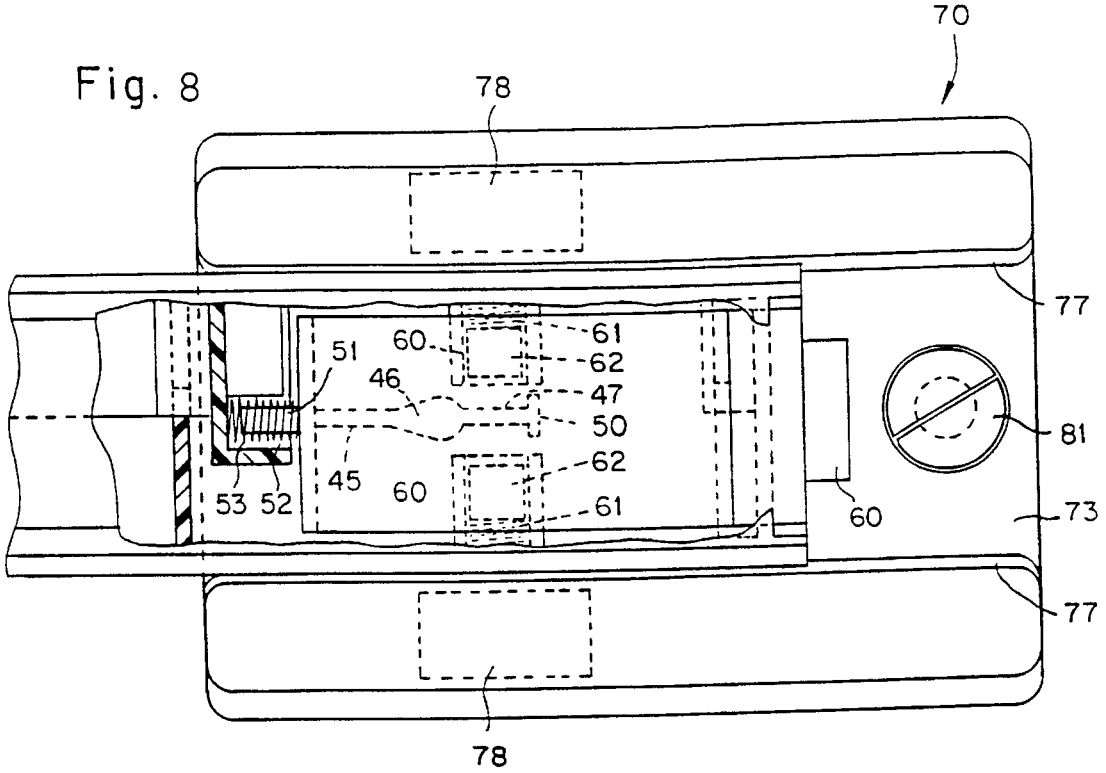
FIG. 8 is a sectional view of the security case of the present invention showing the actuator being unlocked by the decoupler.
Figure 9:
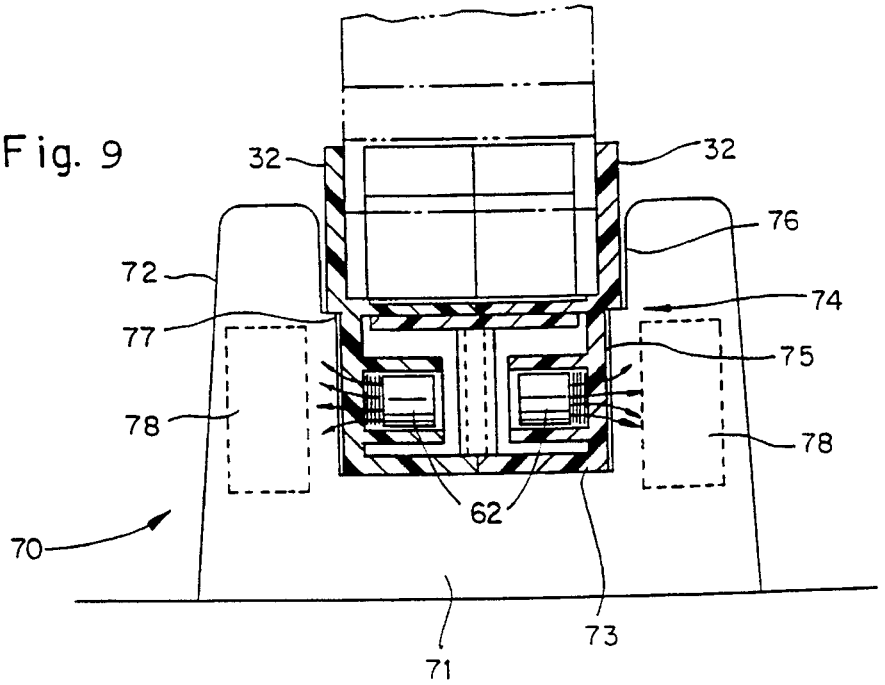
FIG. 9 is a sectional view of the end of the security case showing the actuator being unlocked by the decoupler.

Referring to FIGS. 2, 8 and 9, the release operation for the actuator using the decoupler 70 is described. The lock 30, fastened to the case 21, is brought in contact with the decoupler by placing the housing 31 on the flat surface 73 with the outer surface of the portion 40 facing the vertical cross rib structure 80. As noted above, the lower surfaces of the flanges 32 will ride on ledges 77 during the release operation. Next, the latched case is swiftly moved in a horizontal direction towards the vertical cross rib structure 80. This swift movement results in sharp contact between the outer surface of the portion 40 and the vertical cross rib structure. The sharp contact further compresses the spring 52, allowing the outer edges of the steel pins 62 to move away from the junction between the flat portion 47 and the curved portion 46 in each of the seats. This small movement is shown in FIGS. 7C and 8 as a slight shift in position of the steel pins 62. With the position of the steel pins 62 shifted, the force of each spring 61 on a corresponding steel pin is isolated, allowing the magnets 78 to draw the pins toward the sleeves, releasing the actuator. With the actuator released, the force exerted by the spring 52 on the portion 43 moves the actuator to an open position.

While the present embodiment uses the spring 52 to bias the actuator 90 to the open position, the spring is not required. Without the spring 52, the outer edge of each of the steel pins 62 is not forced to rest against the junction between the curved segment 46 and the flat segment 47 when the actuator is in the closed position. This eliminates the need for swift movement of the latched case towards the vertical cross rib structure 80. To release the actuator 90, the decoupler 70 is mounted vertically with an outer surface of the rib structure 80 facing downward and the outer surface of the hook portion 40 of the lock 30 is brought in contact with the vertical cross rib structure 80 of the decoupler. The lower surfaces of the flanges 32 of the lock 30 should be on ledges 77 of the decoupler. In this position, the magnets 78 draw the pins toward the sleeves 60, releasing the actuator. Gravity holds the released actuator against the vertical cross rib structure 80. To position the actuator in the open position, the case 21, attached to the lock 30 by L-shaped hook 34, is moved vertically upward along the ledges 77 of the decoupler 70.

There accordingly has been described a security device for protecting displayed merchandise from theft using a case to receive the merchandise and a locking mechanism latching the case. The case and locking mechanism provide protection for video game cartridges and CDs in a live merchandising format without increasing inventory space. The locking mechanism has a cross-piece with a recessed surface for a security strip and when the locking mechanism latches the case closed, the case is positioned on the cross-piece, making the security strip inaccessible to customers.

The many features and advantages of the invention are apparent from the detailed specification, and thus, it is intended by the appended claims to cover all such features and advantages of the invention which fall within the true spirit and scope of the invention. Since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A security device comprising:

a case having a lid opening to receive merchandise, a bottom surface and two opposing sidewall surfaces each having a recess or notch near the lid opening; and a locking mechanism for latching the case, the locking mechanism including a base housing, at least one flange extending from the base housing to overlie a portion of the lid, preventing the lid from being opened, a fixed member of the housing for engaging one of the recesses or notches of the case, a movable member for (i) engaging the other recess or notch of the case when the locking mechanism is closed and (ii) disengaging from the other recess or notch of the case when the locking mechanism is open allowing the locking mechanism to become fully separated from the case, and a steel pin retained in at least one sleeve attached to an inner surface of the base housing and biased against a surface of the movable member for retaining the movable from moving when the locking mechanisms closed.

2. The security device of claim 1, wherein the steel pin is biased against a surface of the movable member by a spring between said steel pin and a corresponding inner surface of the base housing.

3. The security device of claim 1, further including a decoupler for releasing the retained movable member when the locking mechanism is closed.

4. The security case of claim 3, wherein the decoupler comprises:

a U-shaped housing with a flat upper surface, two inner surface extending from the flat upper surface, an outer surface corresponding to each inner surface, a vertical cross rib attached to the flat upper surface between the two inner surfaces, and a magnet positioned in the U-shaped housing between at least one inner surface and the corresponding outer surface, the magnet attracting the steel pin when the closed locking mechanism is positioned in the decoupler with movable member engaging the vertical cross rib.

5. The device of claim 4, wherein the locking mechanism for latching the case includes two steel pins, each retained in a sleeve attached to an inner surface of the base housing, and biased against a surface of the moveable member for retaining the movable member when the locking mechanism is closed, and the decoupler includes a magnet positioned in the U-shaped housing between each inner surface and the corresponding outer surface.

6. A locking mechanism for preventing opening of a case having two opposing sidewalls, each with a recess or notch, comprising:

a housing having a main surface;

two generally parallel flanges extending from the main surface of the housing;

a fixed member at one end of the housing for engaging one of the recesses or notches of the case;

a movable member at the other end of the housing for engaging the other recess or notch of the case and being movable between open and closed positions; and a device in the housing for retaining the movable member closed, wherein the movable member comprises:

an upper surface parallel to the main surface of the housing, an outer end for engaging said other recess or notch, an inner end extending downward from the upper surface at a generally right angle, and a cross element attached beneath the upper surface and extending from the inner end to the outer end.

7. The locking mechanism of claim 6, wherein the cross element has opposing outer surfaces with at least one outer surface having a curved segment attached between an inner and outer flat segment, the curvature of the curved segment is greater at the junction with the outer flat segment than at the junction with the inner flat segment.

8. The locking mechanism of claim 7, wherein the device in the housing for retaining the movable member closed includes a steel pin retained in at least one sleeve attached to an inner surface of the housing and biased against said at least one outer surface of the cross element which has a curved segment attached between an inner and outer flat segment, when the movable member is moved between open and closed positions.

9. The locking mechanism of claim 8, further including a decoupler for releasing the device in the housing retaining the movable member closed.

10. The locking mechanism of claim 9, wherein the decoupler comprises:

a U-shaped housing with a flat upper surface, two inner surfaces extending from the flat upper surface, an outer surface corresponding to each inner surface, a vertical cross rib attached to the flat upper surface between the two inner surfaces, and a magnet positioned in the housing between at least one inner surface and the corresponding outer surface, the magnet attracting the steel pin when the locking mechanism, with the movable member in the closed position, is positioned in the decoupler with the outer end of the movable member engaging the vertical cross rib.

11. The device of claim 10, wherein the device in the housing for retaining the movable member closed includes two steel pins, each retained in a sleeve attached to an inner surface of the housing and biased against a surface of the moveable member, and the decoupler includes a magnet positioned in the U-shaped housing between each inner surface and the corresponding outer surface.

12. An anti-theft apparatus for merchandise on live display comprising:

a case for receiving the merchandise;

a locking mechanism for the case, the locking mechanism including a base housing having a fixed member and a movable member spaced apart from each other, the movable member moving between open and closed positions, and a device in the base housing for retaining the movable member in the closed position; and a decoupler for releasing the retained movable member from the closed position, wherein the fixed member and movable member together couple to separated regions of the case when the locking mechanism is in a locked condition, and when the locking mechanism is in an unlocked condition the movable member extends into the open position allowing the locking mechanism to become fully separated from the case, the base housing has an upper surface with a recess for receiving a security strip, the case has a lid opening to receive the merchandise, a bottom surface and two opposing sidewall surfaces with a recess or notch in each of the two opposing sidewall surfaces, and the movable member comprises:

an upper surface generally parallel to the main surface of the base housing, an outer end for engaging one of the recesses or notches of the case, an inner end extending downward from the upper surface of the housing at generally a right angle, and a cross element attached beneath the upper surface of the movable member and extending from the inner end towards the outer end thereof.

13. The anti-theft apparatus of claim 12, wherein the cross element has opposing outer surfaces with at least one outer surface having a curved segment attached between an inner and outer flat segment, and the curvature of the curved segment is greater at the junction with the outer flat segment than at the junction with the inner flat segment.

14. The anti-theft apparatus of claim 13, wherein the device for retaining the movable member in the closed position includes a steel pin retained in least one sleeve attached respectively to one of two opposing inner surfaces of the housing, and biased against a respective outer surface of the cross element during opening and closing of the actuator.

15. The anti-theft apparatus of claim 14, wherein the decoupler comprises:

a U-shaped housing with a flat upper surface, two inner surfaces extending from the flat upper surface, an outer surface corresponding to each inner surface, a generally vertical cross rib attached to the flat upper surface between the two inner surfaces, and a magnet positioned in the U-shaped housing between at least one inner surface and the corresponding outer surface, the magnet attracting the steel pin when the locking mechanism, with a closed actuator, is positioned in the decoupler with the outer end of the actuator engaging the vertical cross rib.

16. The device of claim 15, wherein the device for retaining the movable member in the closed position includes two steel pins, each retained in a sleeve attached respectively to one of the two opposing inner surfaces of the housing, and biased against a respective outer surface of the cross element during opening and closing of the actuator, and the decoupler includes a magnet positioned in the U-shaped housing between each inner surface and the corresponding outer surface.

17. A securing device comprising:

a case having an access opening to receive merchandise, top and bottom surfaces, and two opposing sidewall surfaces having, respectively, first and second coupling elements near the access opening; and a locking mechanism for maintaining the case enclosed when the locking mechanism is closed, the locking mechanism being fully separable from said case when the locking mechanism is open and including a base housing, two generally parallel flanges extending from the base housing and spaced apart from each other to receive and retain the top and bottom surfaces of said case and prevent access to at least a portion of an interior region of the case through said access opening, a fixed engagement element on the base housing for releasably engaging the first coupling element of the case, a movable engagement element on the base housing for engaging the second coupling element of the case when the movable engagement element is in a first position and disengaging from the second coupling element of the case when the movable engagement element is in a second position, and a locking device in the base housing retaining the movable coupling element in the first position when the locking mechanism is closed, wherein said top surface of said case comprises a lid for enclosing said access opening, and with the two generally parallel flanges of the locking mechanism positioned to overlie a portion of the lid and another surface of the case, and the fixed engagement element engaging one of the coupling elements of the case, the movable engagement element (i) engages a corresponding coupling element of the case when the locking mechanism is closed, and (ii) disengages from said corresponding coupling element of the case when the locking mechanism is open allowing the locking mechanism to be to be fully separated from the case.

* * * * *